United States Patent [19]

Lilienthal

[11] 4,262,375

[45] Apr. 21, 1981

[54] PATIENT TRANSFER APPARATUS

[76] Inventor: Alfred J. Lilienthal, 398 Burke St., Bourbonnais, Ill. 60914

[21] Appl. No.: 88,409

[22] Filed: Oct. 26, 1979

[51] Int. Cl.[3] ..... A61G 7/02

[52] U.S. Cl. ..... 5/81 B; 5/86; 5/90; 5/463

[58] Field of Search ..... 5/81 R, 81 B, 81 C, 5/86, 90, 191, 463

[56] References Cited

U.S. PATENT DOCUMENTS

| | | | |
|---|---|---|---|
| 2,187,198 | 1/1940 | Fields | 5/89 |
| 2,565,761 | 8/1951 | Dean | 5/81 B |
| 3,452,371 | 7/1969 | Hirsch | 5/81 B |
| 3,562,824 | 2/1971 | White | 5/90 |
| 4,073,016 | 2/1978 | Koll | 5/86 |

*Primary Examiner*—Casmir A. Nunberg
*Attorney, Agent, or Firm*—Anthony S. Zummer

[57] ABSTRACT

This invention relates to a hospital patient transporter for lifting a hospital patient from one location, such as, a hospital bed, moving the patient horizontally from the bed to a cart and depositing the patient on the cart, or vise versa. The transporter includes a pair of extendable rails which are particularly adapted for connection to a hospital bed. A carrier is movably mounted on the rails for moving the carrier horizontally on the rails. A patient support is included in the carrier for supporting a patient in a substantially horizontal attitude. A drive is connected to the patient support for selectively raising or lowering a patient carried on the patient support.

5 Claims, 14 Drawing Figures

FIG. 5
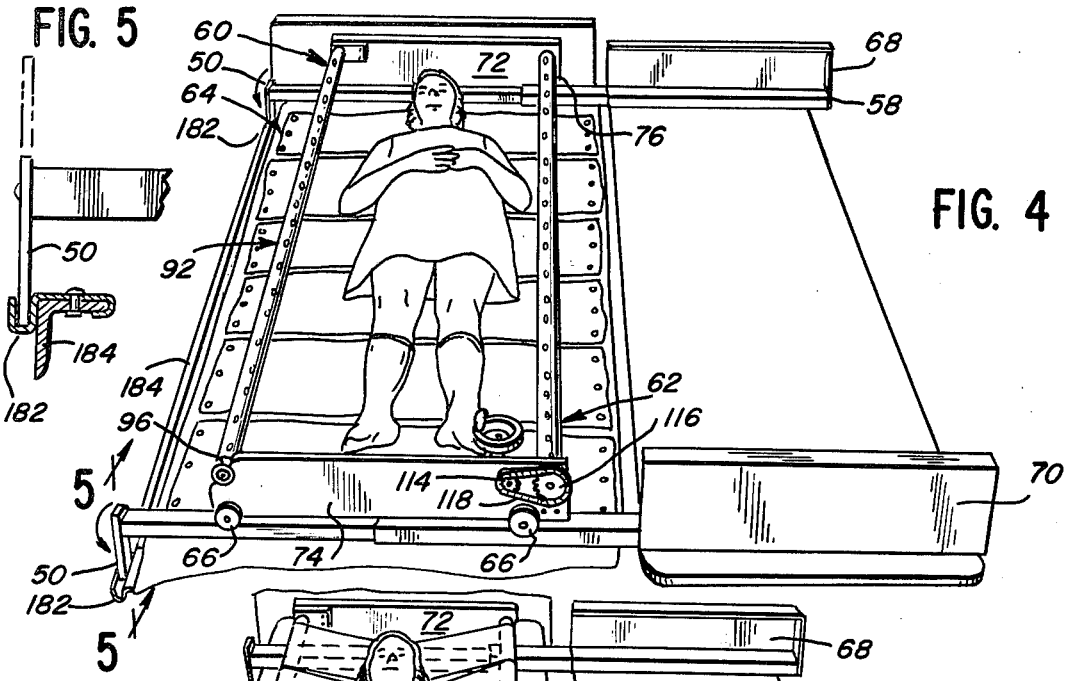
FIG. 4
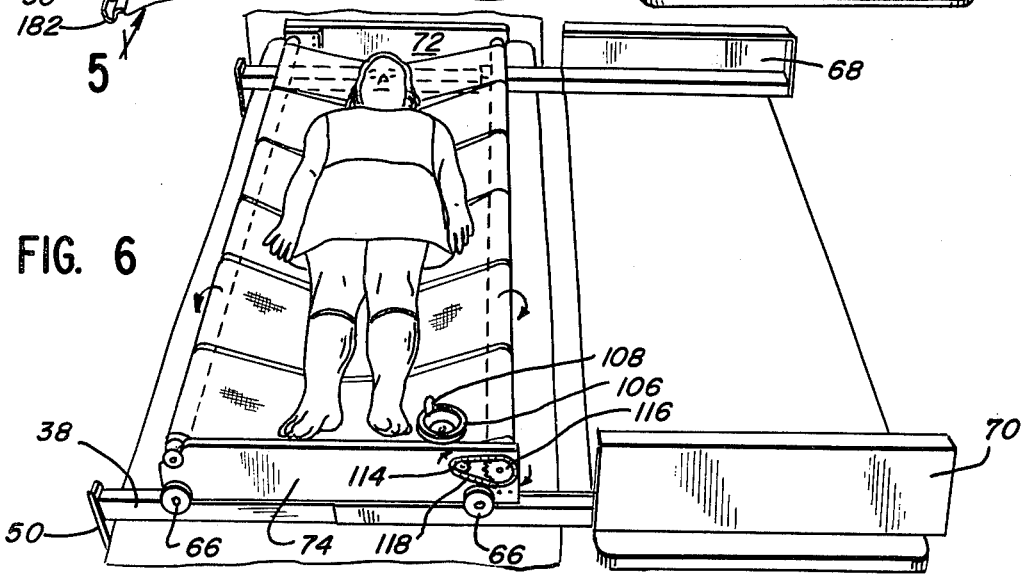
FIG. 6
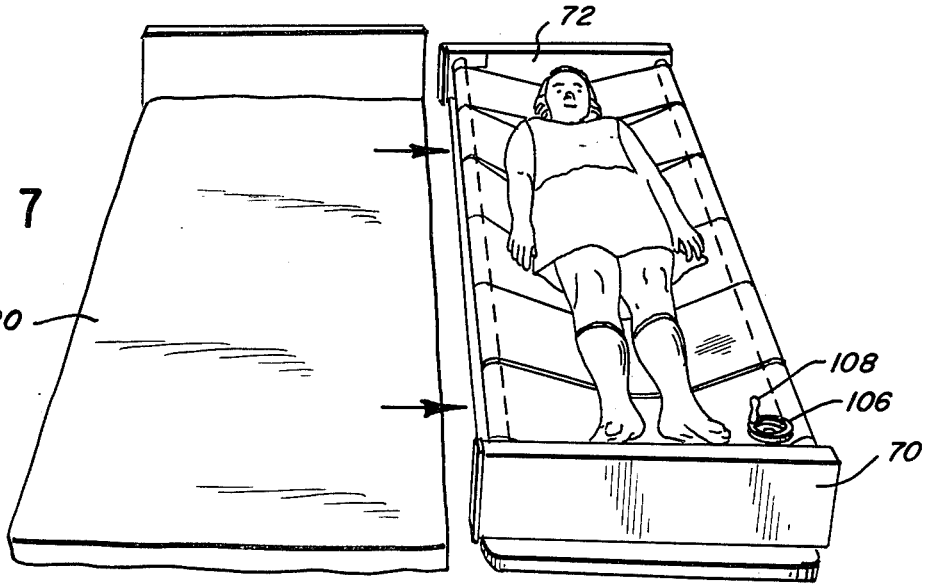
FIG. 7

FIG. 11
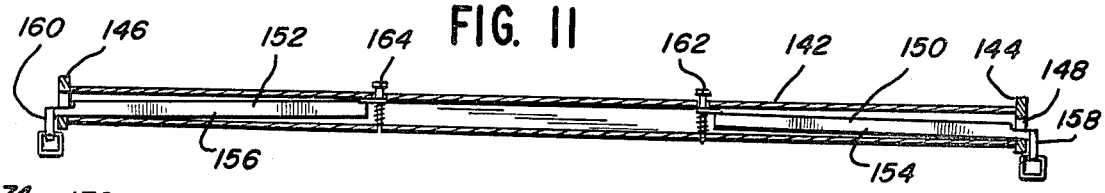
FIG. 12
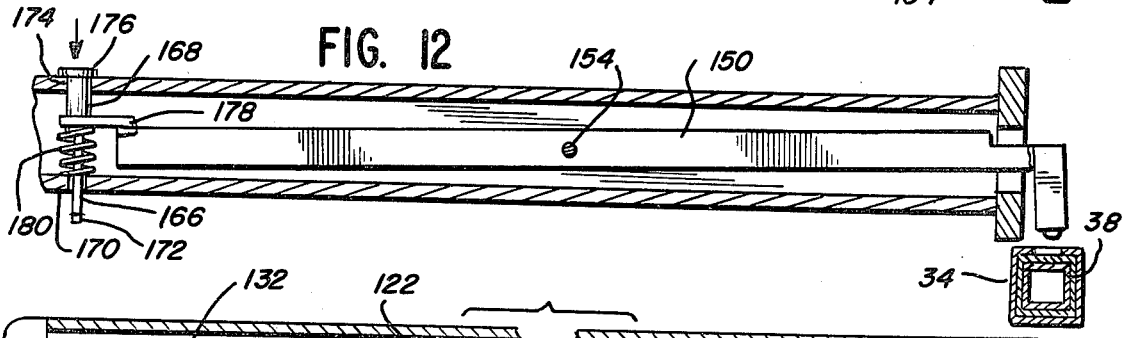
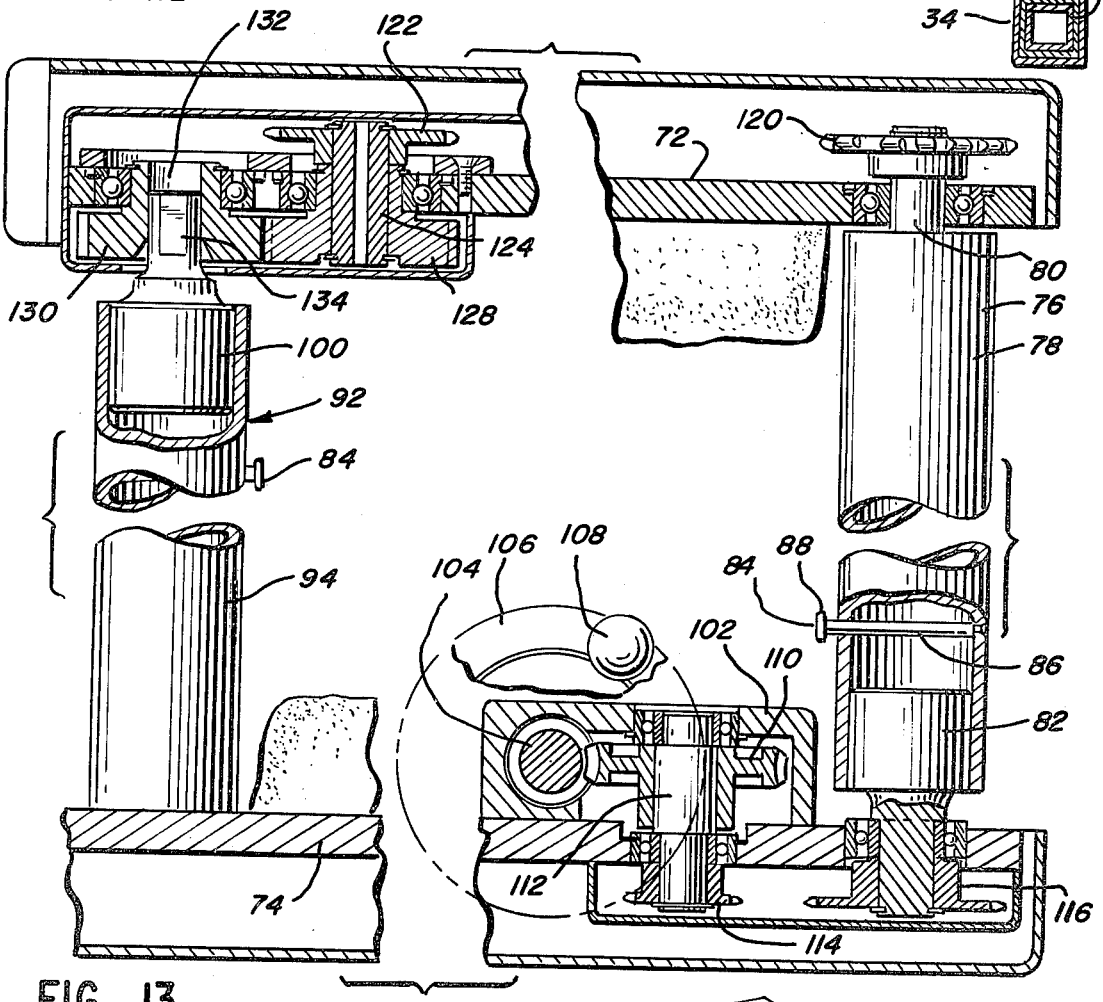
FIG. 13
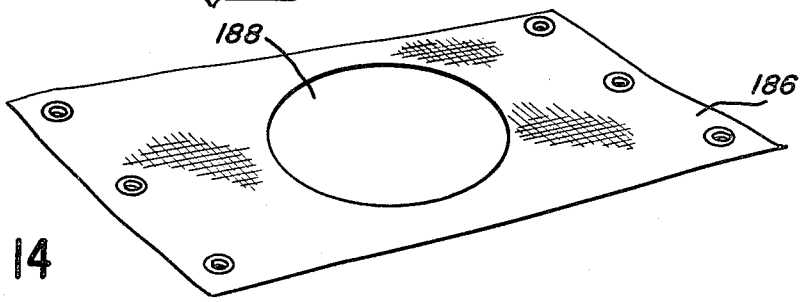
FIG. 14

PATIENT TRANSFER APPARATUS

BACKGROUND OF THE INVENTION

The subject invention relates to a patient transport device which is particularly adapted for use in a hospital. It is generally well known and accepted that the handling of a nonambulatory patient in a hospital presents a serious problem for hospital personnel. It goes without saying that the larger and the heavier the patient, the greater the problems.

In the normal course of hospital care, often times a nonambulatory patient must be transferred from the bed to some other location in the hospital. This is accomplished by lifting the patient from the hospital bed and placing him on a cart or gurney. The patient is then wheeled to another location, such as, an x-ray room, or a physical therapy room. The patient is lifted from the cart onto another location such as an x-ray table, or a physical therapy table. The process is then reversed to return the patient to his own bed.

There are a number of devices available which provide means for lifting a patient. Types of these devices are those which are disclosed in the following: U.S. Pat. No. 2,733,425 B. G. Tanney entitled Hospital Patient Transfer Device; U.S. Pat. No. 3,452,371 to W. F. Hirsch entitled Hospital Stretcher Cart; U.S. Pat. No. 3,786,523 to Sele entitled Medical Appliance; U.S. Pat. No. 3,967,328 to Cox entitled Load Lifting And Transferring Device with Multiple Powered Belts; U.S. Pat. No. 3,988,790 to Mracek et al entitled Portable Support For Bed Patient; and U.S. Pat. No. 4,073,016 to Koll entitled Transfer Mechanism. The prior art devices are quite complicated in their construction and are expensive to manufacture and to maintain. What is required is a device which is simple to operate and inexpensive to manufacture so that hospitals may be in a position to purchase such a device in sufficient quantity to provide for all of their needs.

The device must be one which may be operated by a single nurse or nurse's aid. It must be relatively maintenance free, and it must be simple to operate.

SUMMARY OF INVENTION

The present invention relates to a simple and inexpensive device which may be operated by a single hospital employee. The device provides a simple mechanism for lifting a hospital patient from one location, moving the patient horizontally to a second location and depositing the patient at the second location or vice versa. The device includes a pair of substantially parallel rails. The rails have one portion fixed relative to each other, and each of the rails is extendable. A carrier is mounted on the rails and moves along the rails from one position to another. The carrier includes a patient support. The patient support is particularly adapted for supporting a human being in a horizontal attitude. A drive is connected to the patient support for raising and lowering a human being carried on the patient support.

BRIEF DESCRIPTION OF THE DRAWINGS

FIG. 4 is similar to FIG. 2 but showing a frame positioned adjacent to the patient and positioned on the extended rails;

FIG. 5 is an enlarged fragmentary cross section figure taken on line 5—5 of FIG. 4 showing an end portion mounted on the hospital bed;

FIG. 6 is a perspective view similar to FIG. 4 but showing a patient supported on a patient support;

FIG. 7 is a perspective view showing the patient transported horizontally from the position of FIG. 6;

FIG. 11 is a cross sectional view of a lock for locking the carrier to the rails;

FIG. 12 is an enlarged cross sectional view of a portion of the lock shown in FIG. 11;

FIG. 13 is an enlarged fragmentary partial cross sectional view of a drive of the carrier; and FIG. 14 is a perspective view of a mat containing an aperture for use with a patient.

THE DESCRIPTION OF THE PREFERRED EMBODIMENT OF THE INVENTION

Figure 1:
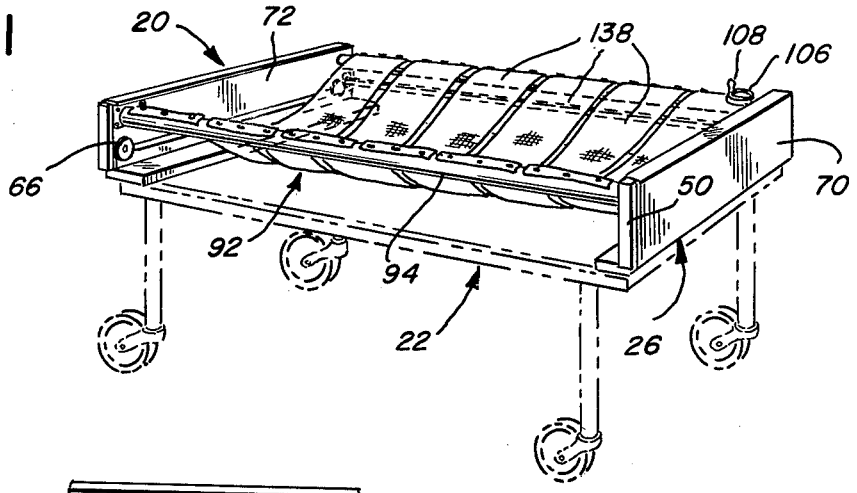
FIG. 1 is a perspective view of a patient transporter embodying the present invention shown mounted on a hospital gurney which is shown in dotted form.
Figure 8:
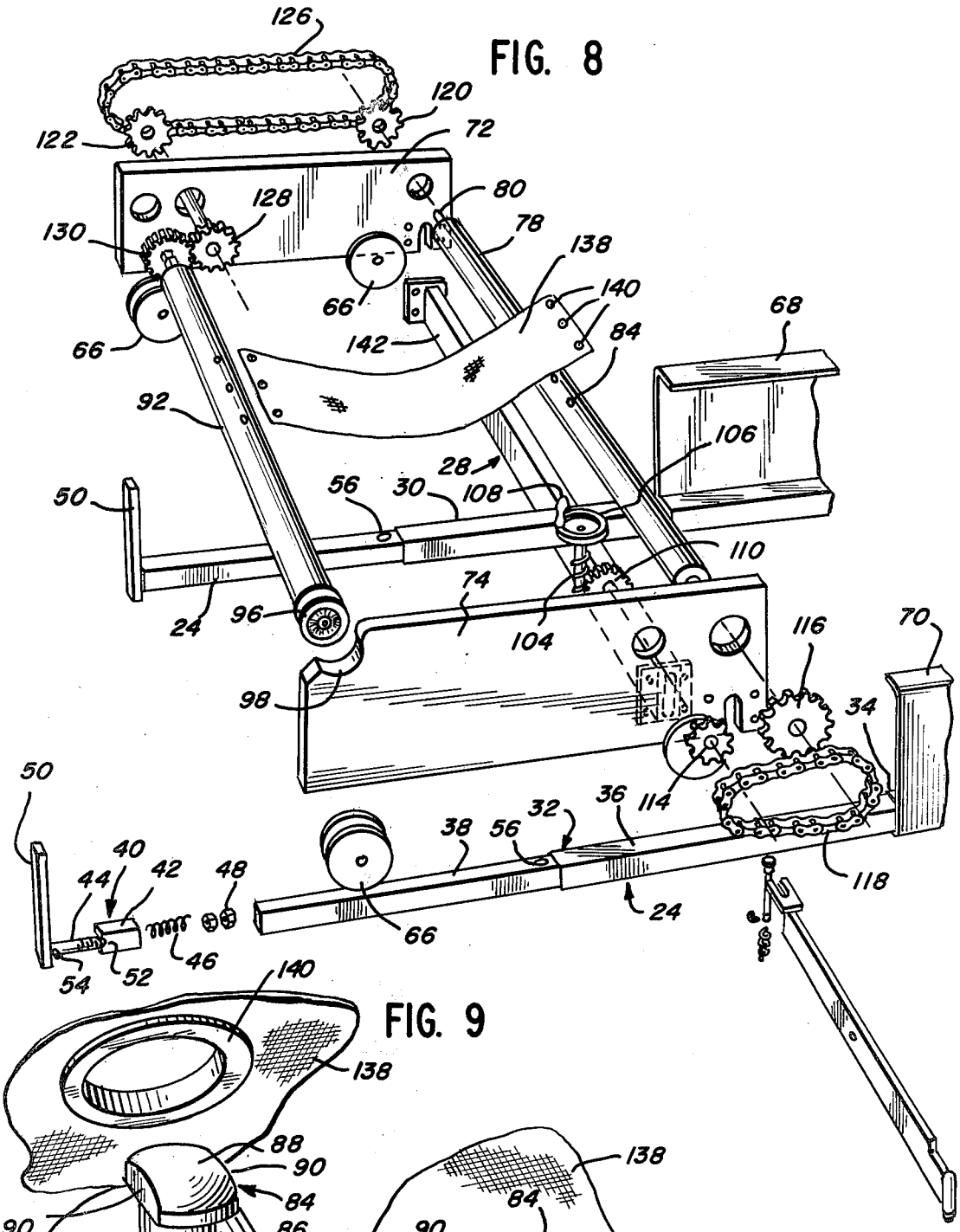
FIG. 8 is an exploded view of a portion of a carrier.

Referring now to the drawings and specifically to FIG. 1, a patient transporter generally indicated by number 20 is a specific embodiment of the herein disclosed invention. Transporter 20 is mounted on a portable gurney generally indicated by number 22. The transporter generally includes a track 24 which is best seen in FIG. 8. A carrier is movably mounted on the track, and a lock 28 is mounted with carrier for releasably locking the carrier to the track.

The track, as may be best seen in FIGS. 8 and 12, includes a pair of identical rails 30 and 32. Referring now specifically to rail 32, it may be seen that the rail includes a fixed section 34 which has a square cross section. An intermediate hollow section 36 is slidably and matedly mounted in fixed section 34 and has a shape which is similar to the shape of section 34. An inner hollow section 38 is slidably and matedly mounted in intermediate section 36. The inner section 38 is also square in cross section so that it snugly mates with the interior of the intermediate section. A support head 40 is mounted on the end of inner section 38. The intermediate section and inner sections are interlocked by a conventional means so that the sections are not pulled out from each other when the rail is extended. Support head 40 includes a support block 42 which is fixed in the free end of inner section 38. A support shaft 44 is slidably and rotatably mounted in support block 42. A support spring 46 is mounted on the end of the shaft 44 along with a fastener 48 which holds the spring on position. A support arm 50 is fixed to the other end of shaft 44. Support block 42 contains a groove 52, which receives a positioning pin 54 mounted on shaft 44 adjacent to arm 50. It may be seen that arm 50 may be extended away from the block 42 and rotated 180°. Pin 54 is positioned in groove 52 to position arm 50 in a selected position.

As mentioned above, the carrier is releasably locked to the rails by means of lock 28. Each section of each rail contains a lock aperture 56 for cooperation with lock 28.

The carrier generally includes a base 58, a frame 60 which is movably mounted on the rails, a drive 62 mounted on the frame, a patient support 64 releasably connected to the frame, and wheels 66 mounted on the frame for movably supporting the carrier on the rails.

The base includes a head end 68 and a foot end 70. The rails 30 and 32 are secured to the top of the gurney through base 58 adjacent to the ends 68 and 70 respectively.

Frame 60 includes a head plate 72 and a foot plate 74. The head plate 72 and foot plate 74 are connected by an inboard roller 76 which is rotatably mounted in the head and foot plates. The inboard roller is best seen in FIG. 13. The inboard roller includes a tubular hollow shaft 78 which has a head sprocket shaft 80 mounted in the head end of the roller. A driven sprocket shaft 82 is mounted in the foot end of the tubular hollow shaft 78. A plurality of fasteners 84 is mounted in the roller. Each fastener includes a column 86 which is fixed in the shaft. A circular head 88 is formed integral with the end of each column extending outside of the tubular hollow shaft 78. Each head 88 has a pair of opposed flattened sides 90 to facilitate receipt of a portion of the patient support as will be disclosed in detail hereinafter.

Frame 60 also includes an outboard roller 92 which is removably mounted on the head and foot plates. Roller 92 includes a tubular shaft 94 with a roller wheel 96 mounted on the foot end of the shaft. Foot plate 74 includes a recess 98 for receipt of the roller wheel 96. A hexagon-ended shaft 100 is mounted in the head end of tubular shaft 94. A plurality of fasteners 84 is secured to the tubular shaft 94.

Drive 62 is mounted on frame 60 and includes a drive housing 102 mounted on the foot plate. A worm 104 is rotatably mounted in the housing and an operating wheel 106 is secured to worm 104. Wheel 106 has a conventional handle 108 mounted thereon to facilitate turning of the wheel. A worm wheel 110 drivingly engages worm 104. The worm wheel is fixed to a worm wheel shaft 112 which is rotatably mounted in the foot plate and in housing 102. A drive sprocket 114 is fixed to shaft 112. A tube sprocket 116 is mounted on driven sprocket shaft 82 which is secured to tubular shaft 78. A chain 118 drivingly connects sprockets 114 and 116. A tube sprocket 120 is mounted on the head sprocket shaft 80 of tubular shaft 78. A head sprocket 122 is mounted on the sprocket shaft 124 which is rotatably mounted in head plate 72. A head chain 126 drivingly connects sprockets 120 and 122. A pinion 128 is mounted on shaft 124 for rotation therewith. A tube gear 130 is rotatably mounted in head plate 72 in driving engagement with pinion 128. The tube gear 130 contains hexagon aperture 132 for receiving a drive stud 134 which is part of shaft 100.

Patient support 64 includes a plurality of identical strip mats 138. Each strip mat is a strip of tetrafluoroethylene which has metal eyes 140 mounted in each end for engagement with respective fasteners 84.

Figure 9:
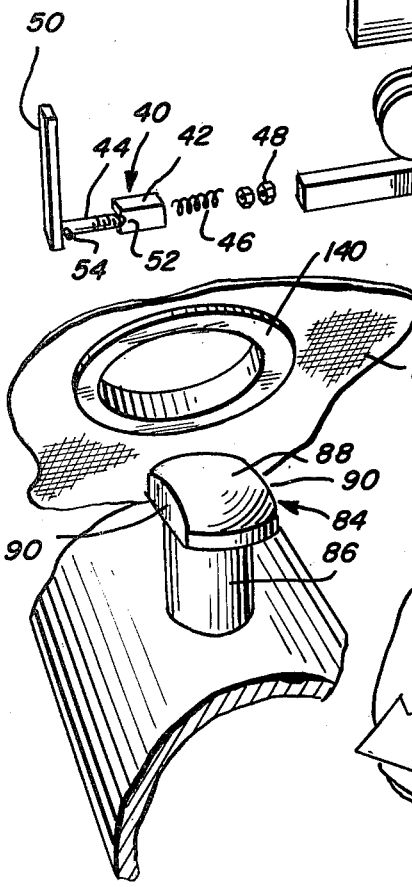
FIG. 9 is an enlarged fragmentary perspective view of a fastener on a roller and a metal eye in a mat.
Figure 10:
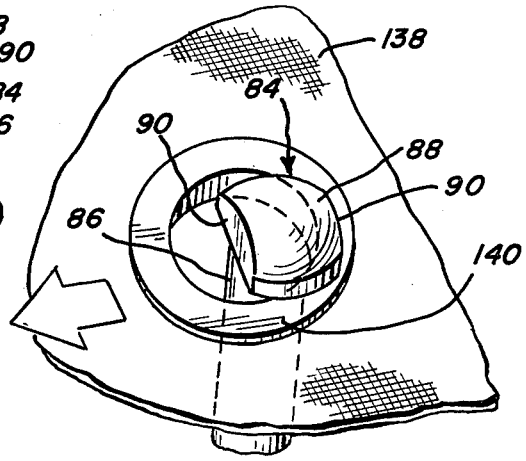
FIG. 10 is an enlarged fragmentary perspective view similar to FIG. 9 showing a portion of a mat in a mounted position.

The interior diameter of the eye is less than the outside diameter of head 88 of the fasteners but greater than the distance between the flats 90 so that the eye may be slipped onto the fastener as shown in FIGS. 9 and 10.

Lock 28 is best seen in FIGS. 11 and 12. Lock 28 includes a tubular bar 142 which has one end secured to head plate 72 and the other secured to foot plate 74. An end plate 144 is secured to one end of the tubular bar and and end plate 146 is secured to the other end. Each end plate has a lock aperture 148 contained therein. A pair of lock arms 150 and 152 is pivotedly mounted in the tubular bar. The lock arms 150 and 152 are mounted on pivot pins 154 and 156 respectively. Lock pins 158 and 160 are formed integral with the lock arms 150 and 152. Lock pins 158 and 160 are positionable in lock apertures 56 in the rails to lock the carrier in place. Lock arms 150 and 152 are controlled by respective control buttons 162 and 164. The control buttons are identical in construction and the construction of control button 162 which is best seen in FIG. 12 is described below. Control button 162 includes a shaft 166 which has a head 168 formed on one end. Shaft 166 passes through a lock shaft aperture 170 in the tubular bar. A lock ring 172 is mounted on the shaft 170. Head 168 passes through a lock head aperture 174 aligned with the aperture 170 in tubular bar 142. A head flange 176 is formed on the upper end of head 168 to prevent the head from passing completely through the aperture 174. Shaft 166 includes a groove 117 which receives a lock plate 178. Lock plate 178 is welded to one end of arm 150. A lock spring 180 is mounted on shaft 166 in engagement with the interior of the tubular bar 142 and with plate 178 to urge head 168 upward.

Figure 2:
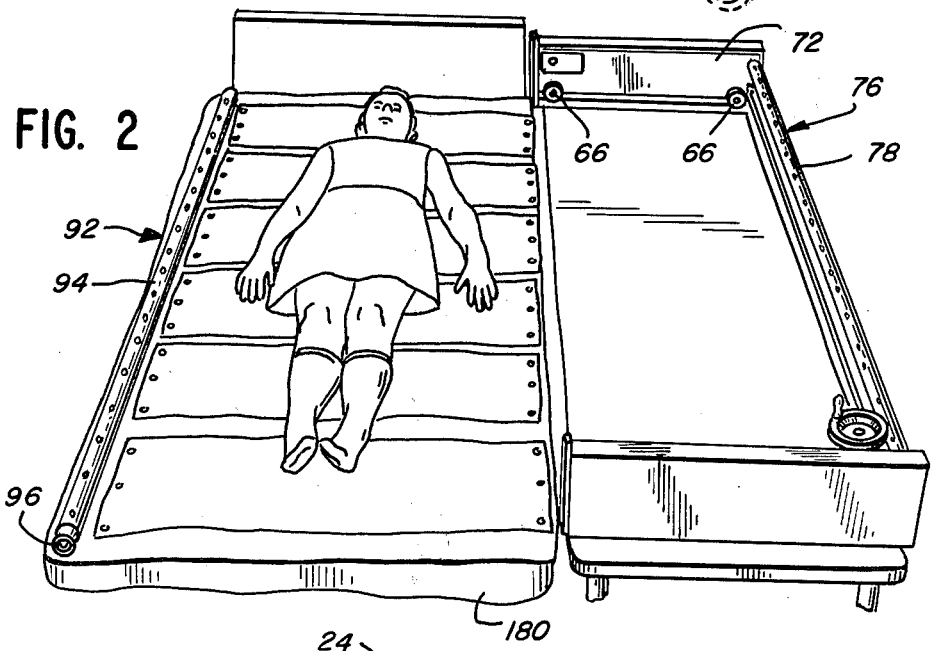
FIG. 2 is a perspective view showing the transporter of FIG. 1 adjacent to a hospital bed with a portion of a patient support positioned under a patient.

Transporter 20 is used in the following manner. The transporter is wheeled adjacent to a conventional hospital bed 180. The mats 138 are then disengaged from the rollers 60 and 76. The mats are slipped under the patient at regular intervals. It is important to note that since the mats have tetrafluoroethylene surfaces, they can be slipped under a patient with a great deal of ease even if a patient is large and heavy. A single hospital employee cans slide the mat under the patient by depressing a supporting mattress sufficiently to slide the mat under the patient and then the mat may be pulled through with a high degree of facility. The removable roller 92 is lifted out of the foot plate 74 and slipped out of engagement with the gear 130. The roller is then laid on the bed or some other convenient position as shown in FIG. 2.

Figure 3:
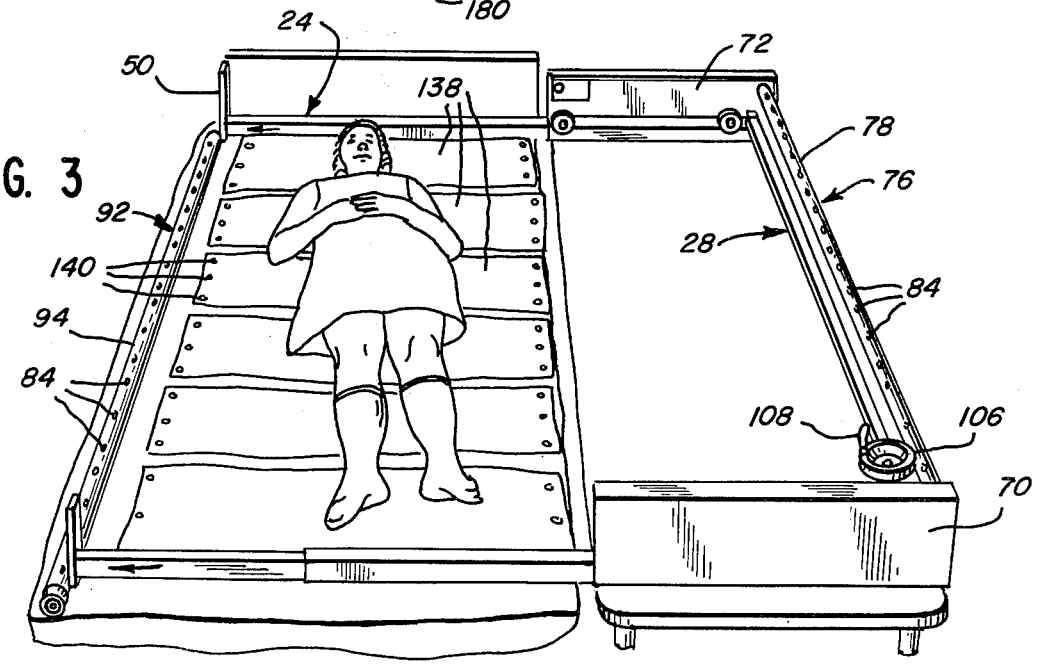
FIG 3 is a perspective view similar to FIG. 1 but showing a pair of rails extended.

Rails 30 and 32 are extended to the position shown in FIG 3. Once the rails are fully extended, head 50 of each of the rails is rotated 180° so that each head 50 is placed into engagement with a bracket 182 which is mounted on a frame 184 of hospital bed 180. Thus the transporter is held securely to the bed.

Lock 28 is released so that the head plate and the foot plate may roll on the rails toward the patient. The lock engages the rails to lock the head plate and the foot plate into position adjacent to the patient. Roller 92 is reinserted in the head plate and foot plate so that the attitude of the patient is such as that shown in FIG. 4.

The mats are secured to rollers 76 and 92. Wheel 106 is rotated via handle 108 to turn worm 104 which in turn drives wheel 110. The rotation of the wheel turns both rollers 76 and 92 in opposite directions so that the mats are wound onto the rollers as shown in FIG. 6. Thus, the patient is lifted off of the surface of bed 180. The patient is lifted sufficiently to clear the bed and gurney 22. The patient is moved horizontally by rolling the carrier on the rails to a position above the gurney. The return of the carrier to its original position allows the carrier to lock into place. The employee then rotates the heads 50 and simply pushes the rails back into the respective fixed portions so that the attitude of the patient is such as shown in FIG. 7.

Once the patient is positioned over the gurney, the patient may be lowered onto the gurney or left suspended on the mats. The patient is then transported to another area such as an x-ray room, surgery, physical therapy or other part of the hospital. The patient may be returned either on the gurney or the patient may be placed on another supporting surface simply by reversing the process. In reversing the process, the rails are extended, the patient is wheeled on the patient support on the rails, the patient is lowered onto the surface, the mats are slipped out from under the patient. The removable roller is removed to retract the head plate and foot plate. The removable roller is reinserted and the transorter may be used to transport another patient, if necessary. The patient then may be returned to the hospital bed by lifting the patient from the other support surface as described above to return the patient to the hospital bed.

The instant transporter also provides another important function in that a mat 186 may be utilized. As may be best seen in FIG. 14, mat 186 is identical in construction as other mats but contains a large central aperture 188 in its center. Mat 186 is positioned under the lower portion of a patient's trunk and the patient is raised by use of the instant device in order to place a bed pan under the patient to collect bodily wastes from the patient. The transporter is then used primarily to lift the patient from the hospital bed rather than move the patient to another area of the hospital.

Although a specific embodiment of the herein disclosed invention has been shown and described in detail above, it is readily apparent that one skilled in the art may make various modifications and changes without departing from the spirit and scope of the present invention. It is to be expressly understood that the instant invention is limited only by the appended claims.

What is claimed is:

1. A hospital patient transporter for lifting a human being from one location, moving the human being horizontally and then depositing the human being at a second location comprising; a pair of substantially parallel extendable rails, each of said rails having one portion fixed relative to a like portion of the other rail, a carrier movably mounted on the rails for moving substantially horizontally on the rails, said carrier having a patient support for supporting a human being in a substantially horizontal atittude, and a drive connected to the patient support for selectively raising and lowering a human being on the patient support, the carrier including a pair of parallel rollers drivingly connected to the drive, one of said rollers being readily removable, said patient support including a plurality of flexible mats being releasably connected to one of said rollers to allow the mats to be positioned under the human being.

2. A hospital patient transporter for lifting a human being from one location, moving the human being horizontally and then depositing the human being at a second location comprising; a pair of substantially parallel extendable rails, each of said rails having one portion fixed relative to a like portion of the other rail, a carrier movably mounted on the rails for moving substantially horizontally on the rails, said carrier having a patient support for supporting a human being in a substantially horizontal attitude, and a drive connected to the patient support for selectively raising and lowering a human being on the patient support, the carrier including a pair of parallel rollers drivingly connected to the drive, one of said rollers being readily removable, the other of said rollers being a drive roller, said patient support including a plurality of flexible mats, each mat having opposite ends releasably connected to said rollers to allow the mats to be positioned under the human being; and said drive including a worm drivingly connected to said drive roller for rotating the, drive roller, a sprocket mounted on said drive roller, a chain connected to said sprocket, a second sprocket connected to said chain, a gear connected to said second sprocket, and a roller gear drivingly connected to the roller to rotate in the opposite direction of the drive roller.

3. A hospital patient transporter for lifting a human being from one location, moving the human being horizontally and then depositing the human being at a second location comprising; a pair of substantially parallel extendable rails, each of said rails having one portion fixed relative to a like portion of the other rail, a carrier movably mounted on the rails for moving substantially horizontally on the rails, said carrier having a patient support for supporting a human being in a substantially horizontal attitude, and a drive connected to the patient support for selectively raising and lowering a human being on the patient support; including a pair of parallel rollers; one of said rollers being drivingly connected to the drive, said patient support including a plurality of flexible mats being releasably connected to said one of said rollers to allow the mats to be positioned under the human being, and fasteners releasably connecting the flexible mats to the one roller, each of said fasteners including a column fixed to the one roller, a circular head having flat sides formed integral with the column, and an annular eye fixed to a respective mat and being engagable with the column, said eye having a diameter slightly less than the diameter of the head but greater than the width of the head between the flat sides.

4. A hospital patient transporter for lifting a human being from one location moving the human being horizontally and then depositing the human being at a second location comprising; a pair of parallel rails, each of said rails having a fixed portion, each fixed portion being tubular and having a square cross section, an intermediate portion matably and slidably mounted in the fixed portion, each intermediate portion being tubular and having square cross section, an inner portion slidably and matably mounted in the intermediate portion, said inner portion having square cross section, and a head mounted on one end of the inner portion for supporting one end of the rail, a head plate, a plurality of head plate wheels mounted on the head plate movably supporting the head plate on one of the rails, a plurality of foot plate wheels movably supporting the foot plate on the other of said rails, a lock connecting the head plate and the foot plate and releasably locking the head plate and the foot plate to the rails, a roller, said roller having one end rotatably mounted in the head plate and the other end rotatably mounted in the foot plate, a worm rotatably mounted on the foot plate, a wheel rotatably mounted on the foot plate and drivingly engaging the worm, a sprocket fixed to the wheel for rotation therewith, a foot chain in driving engagement with the sprocket, a roller sprocket fixed to the roller for rotation therewith and drivingly connected to the foot chain, a second roller rotatably mounted on the head plate and the foot plate and being readily removably therefrom, a drive sprocket mounted on the first mentioned roller for rotation therewith, a head chain in driving engagement with the drive sprocket, a driven sprocket rotatably mounted on the head plate and being in driving engagement with the head chain, a pinion drivingly connected to the driven sprocket, a roller gear rotatably mounted in the head plate and meshing with the pinion, said roller gear being removably drivingly connectable to the second roller, a plurality of fasteners mounted on each of the rollers, each of said fasteners having a fastener column, a fastener head formed integral with each of the columns, each fastener head being circular with a pair of opposed flat sides, a plurality of mats, each of said mats having its opposed ends releasably connected to the rollers, each of said mats having a circular eye mountable on a fastener, each circular eye having a diameter less than the diameter of the head of the fastener but being greater than the distance of the flat sides, and each of said mats having a surface of tetrafluoroethylene for sliding the mat under the human being, whereby rotation of the worm in one direction or other direction selectively winds the mats on the rollers or unwinds the mats on the rollers for raising or lowering a human being on the mats.

5. Hospital patient transporter for lifting a human being from one location, moving the human being horizontally and then depositing the human being at a second location as defined in claim 4, wherein one of said mats contains an enlarged aperture in its central portion to provide an opening to allow a human being to eliminate bodily wastes through the aperture.

* * * * *